US006550617B1

(12) United States Patent
Elva

(10) Patent No.: US 6,550,617 B1
(45) Date of Patent: Apr. 22, 2003

(54) CARD AND GIFT DELIVERY SYSTEM

(76) Inventor: Julia Elva, 945 Almeria Rd., Apt. 1, West Palm Beach, FL (US) 33405

( * ) Notice: Subject to any disclaimer, the term of this patent is extended or adjusted under 35 U.S.C. 154(b) by 0 days.

(21) Appl. No.: 09/759,946

(22) Filed: Jan. 12, 2001

(51) Int. Cl.[7] ..... B65D 73/00
(52) U.S. Cl. ..... 206/457; 206/461; 206/232; 229/92.8
(58) Field of Search ..... 206/232, 461, 206/457, 470; 229/92.8

(56) References Cited

U.S. PATENT DOCUMENTS

| | | | | | |
|---|---|---|---|---|---|
| 282,731 | A | * | 8/1883 | Johnson | 206/127 |
| 296,718 | A | * | 4/1884 | Baldwin | 206/457 |
| 1,144,707 | A | * | 6/1915 | Isenberg | 206/457 |
| 1,180,618 | A | * | 4/1916 | Stirn | 206/457 |
| 1,502,312 | A | * | 7/1924 | Mayhew | 206/311 |
| 2,217,454 | A | * | 10/1940 | Pfeiffer | |
| 3,307,281 | A | * | 3/1967 | Mateo | 206/216 |
| 3,586,349 | A | * | 6/1971 | Green et al. | 206/232 |
| 3,715,816 | A | * | 2/1973 | White | 434/429 |
| 3,767,203 | A | * | 10/1973 | Eaker | 206/315.1 |
| 4,840,275 | A | * | 6/1989 | Faiola et al. | 206/423 |
| 4,951,404 | A | * | 8/1990 | Lithwick | 40/124.06 |
| D322,454 | S | * | 12/1991 | LeBlanc | D19/1 |
| 5,133,496 | A | | 7/1992 | Davidson et al. | |
| 5,407,076 | A | | 4/1995 | Sabet | |
| 5,629,977 | A | | 5/1997 | Fonseca | |
| 5,761,836 | A | | 6/1998 | Dawson | |
| D396,055 | S | | 7/1998 | Ritchey | |

* cited by examiner

*Primary Examiner*—David T. Fidei
(74) *Attorney, Agent, or Firm*—Akerman Senterfitt

(57) ABSTRACT

A card and gift delivery system that provides the user a vehicle for gift delivery. A card and gift delivery system is comprised of a card, a gift receptacle, and a predetermined theme. The gift receptacle provides for receiving a gift item. The gift receptacle has a first surface bearing a graphical image corresponding to the predetermined theme. The card includes text that corresponds to a predetermined theme, and has at least one surface. The predetermined theme may include Christmas, Easter, Thanksgiving, or any special holiday or particular occasion.

21 Claims, 4 Drawing Sheets

CARD AND GIFT DELIVERY SYSTEM

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

This invention relates in general to cards, and in particular to greeting cards.

2. Description of the Related Art

Greeting cards are used to express thoughts and emotions for a variety of occasions. These occasions can include special days, such as holidays, graduations, or an anniversary. On many of these occasions, the sender may want to provide a gift, or momento in celebration of the particular occasion.

Greeting cards have traditionally been used to communicate messages in celebration of several different types of occasions. Greeting cards have also been used as a mechanism for package delivery. For instance, U.S. Pat. No. 4,840,275 discloses a greeting card with package delivery. U.S. Pat. No. 396,055 discloses a gift card with a removable personalized angel doll. However, the prior art does not disclose a card and gift delivery system designed specifically for the particular occasion or the theme of the card. Present systems in the prior art may detract from the aesthetics of the card in an effort to provide a gift in the card.

If a sender wants to send along a gift that corresponds to the theme of the card or particular occasion, the sender will encounter difficulties. To date, there is no device that provides the benefit of uniform card and gift delivery corresponding to a particular theme.

SUMMARY OF THE INVENTION

The present invention relates to a card and gift delivery system for the purposes of providing a user a vehicle for gift delivery in a card environment.

According to the invention, a card and gift delivery system can comprise a card having at least one surface having text. The text of the card corresponds to a predetermined theme. The card also provides a gift receptacle to receive gift items. The card can include a first surface bearing a graphical image corresponding to the predetermined theme of the card. The card may have graphical images on all surfaces corresponding to the theme of the card. Also, the gift receptacle can be shaped or constructed to correspond to a graphical image that is representative of the predetermined theme of the card. The gift receptacle may be permanently or detachably attached to the surface of the card.

The card and gift receptacle provide the benefit of expressing the words of the sender along with the delivery of a gift inside of the gift receptacle in a coordinated or blended form. The card can be used for many occasions. For example, the card and gift receptacle can be used to hold a ring when proposing to a loved one. Also, the card and gift receptacle can be used to hold a set of keys when giving an automobile as a gift. Regardless of the occasion, the receptacle can be suited to compliment the theme of any occasion as expressed by the card.

The present invention also provides the sender the benefit of not having to separately wrap the gift that the sender is sending along with the card. The card and gift receptacle eliminate the need for the sender buying excessive items to separately send a gift, such as wrapping paper, scotch tape, or boxes. The sender can simply insert his gift into the gift receptacle. The fast and efficient use of the gift receptacle saves time and money.

The card and gift receptacle compliment the predetermined theme of the particular occasion. The shape of the gift receptacle can also correspond to the subject matter of the card. The card can include at least one surface bearing text that corresponds to a predetermined theme. For instance, a birthday card bearing text on the surface corresponding to a birthday theme may be inscribed with the words "Happy Birthday". However, the text of the card is not limited to a particular expression and may vary accordingly to correspond to a birthday theme or any predetermined theme. Additionally, the card may possess a plurality of graphical images that further correspond to the theme or subject matter of the card.

The gift receptacle may have an inner surface and outer surface. The gift receptacle may be permanently or detachably coupled to any surface of the card. The gift receptacle can be attached to the surface of the card and provide an opening. The opening allows gifts to be inserted into the gift receptacle. The opening can have closure means to allow gifts inserted into the receptacle to be stored securely. For example, if a ring is placed inside of the receptacle, the sender can fastened buttons along the end of the opening to ensure that the ring is not displaced. The closure mechanism can include any device that allows the opening to be securely closed, such as a zipper, button, or velcro.

The gift receptacle allows the sender to send a customized greeting card with a gift for those special occasions. The gift receptacle may be designed to fit the corresponding theme or subject matter of the occasion. For example, a gift receptacle corresponding to a Christmas theme card can have the design of a Christmas tree or other item associated with the Christmas season. During Thanksgiving, the sender may send a gift using the card and gift delivery system that has a gift receptacle corresponding to a thanksgiving theme, such as a gift receptacle in the shape of a turkey. The gift receptacle can be made from any suitable material necessary for the particular design. The ornate structure of the gift receptacle further compliments the occasion for giving the particular gift inserted into the gift receptacle.

The card can be prepared appropriate for all types of occasions depending on the text associated with the card. The text also can be used to reveal the location with the gift to add an element of surprise. For instance, the card and delivery system may be used to celebrate a graduation. In this context, the text can include a message stating "congratulations", along with a message indicating or hinting that a graduation gift is located in the gift receptacle. Corresponding to a predetermined theme of graduation, the gift receptacle may be in the form of a diploma or bear the image of a diploma. The gift receptacle allows the sender to securely store a gift within the card to accompany his special message. In addition, the receptacle in which the gift is stored is designed in the shape of a graphical image or bear a graphical image that corresponds to the message and the subject matter of the particular occasion. For instance, in celebration of Easter, the gift receptacle may be in the graphical image of any item representative of Easter such as, an Easter egg or a rabbit.

The invention provides a card and gift delivery system that may be used for any occasion, such as Christmas, Easter, Thanksgiving, or any special holiday or particular occasion. Additionally, the gift and card system provides the benefit of allowing the sender to express his personalized thoughts along with a special gift that corresponds to a predetermined theme of the particular occasion.

Thus, the card and gift delivery system is a convenient mechanism suitable for providing a gift in a card environment without detracting from the aesthetics of the card.

BRIEF DESCRIPTION OF THE DRAWINGS

There are presently shown in the embodiments which hare presently referred, it being understood, however, that the invention is not limited to the precise arrangements and instrumentalities shown.

DETAILED DESCRIPTION OF THE PREFERRED EMBODIMENTS

This invention relates to a card and gift delivery system that provides a user a vehicle for gift delivery.

Figure 1:
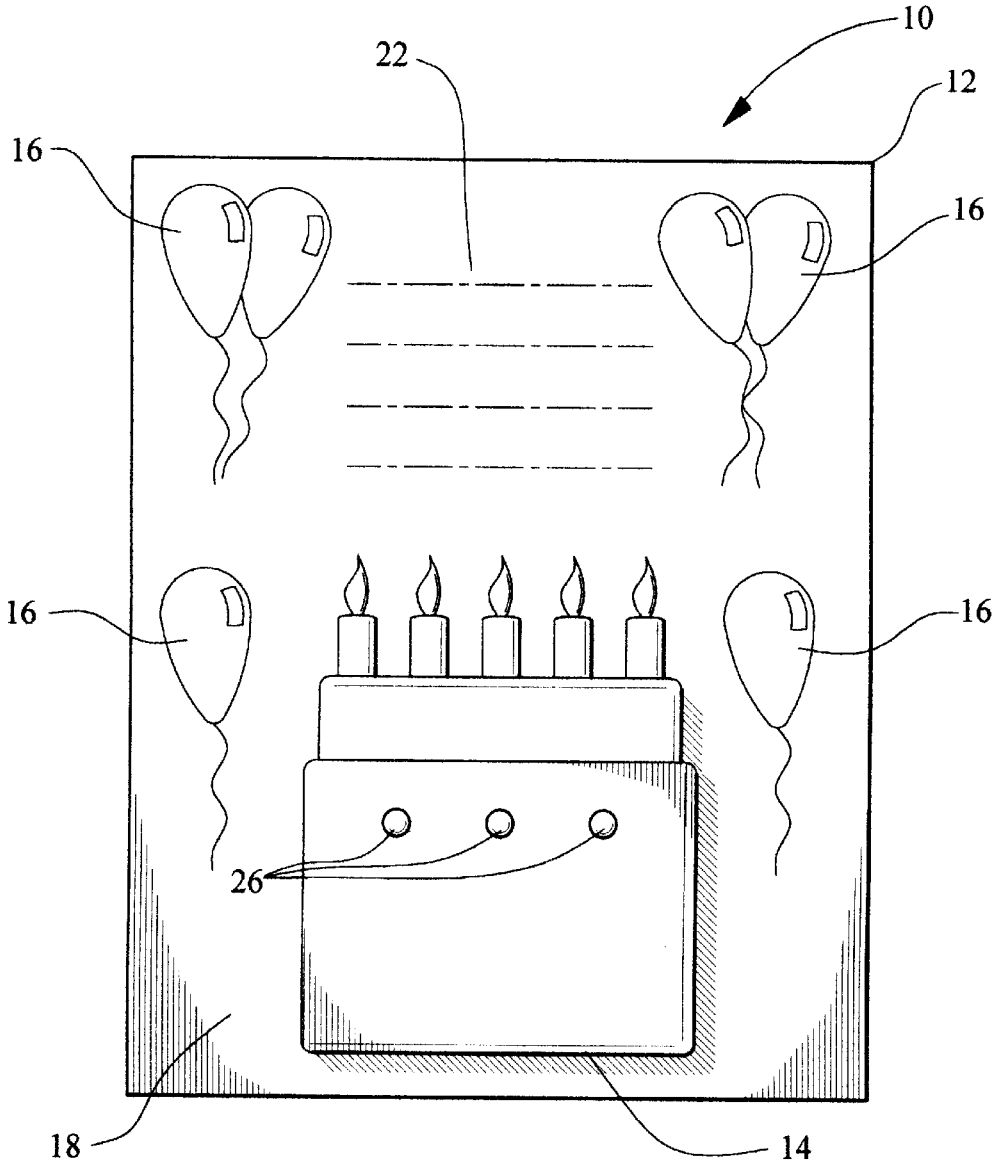
FIG. 1 shows a plan view of a preferred embodiment of the card and gift delivery system.

FIG. 1 depicts an embodiment of the invention which provides for gift delivery. The present invention may be formed from a card 12 having at least one surface 18. The surface 18 of the card may bear text corresponding to the predetermined theme 20 of the card 12. For example, a card 12 corresponding to the Christmas holidays may include text 22 saying "Merry Christmas" or "Happy Holidays". Depending on the corresponding holiday, the text 22 of the card 12 may vary accordingly. The card 12 also provides a gift receptacle 14 for receiving a gift item. The gift receptacle 14 can be provided on a first surface 18 of the card 12 bearing a graphical image 16 corresponding to the predetermined theme of the card 12, such as a birthday theme 20. The graphical image 16 located on the surface 18 of the card 12 may depict any image associated with the corresponding holiday. The gift receptacle 14 is preferably formed in the shape of a figure or structure that corresponds to the holiday or occasion. For example, the card surface 18 and gift receptacle 14 may bear graphical images 16 that corresponds to a birthday theme 20. The graphical image can include a balloon graphic 16 corresponding to a birthday theme. Images corresponding to a birthday theme 20 can also include a cake and candles. A graphical image corresponding to a Christmas theme can include a tree, reindeer, and sleigh. The graphical image depicted on the card surface 18 and gift receptacle 14 in celebration of Easter can include a church, rabbit, and egg. The graphical image depicted by the shape of the gift receptacle 14 and the surface 18 of the card are associated by the purchasing public to correspond to a particular holiday or occasion.

Figure 2:
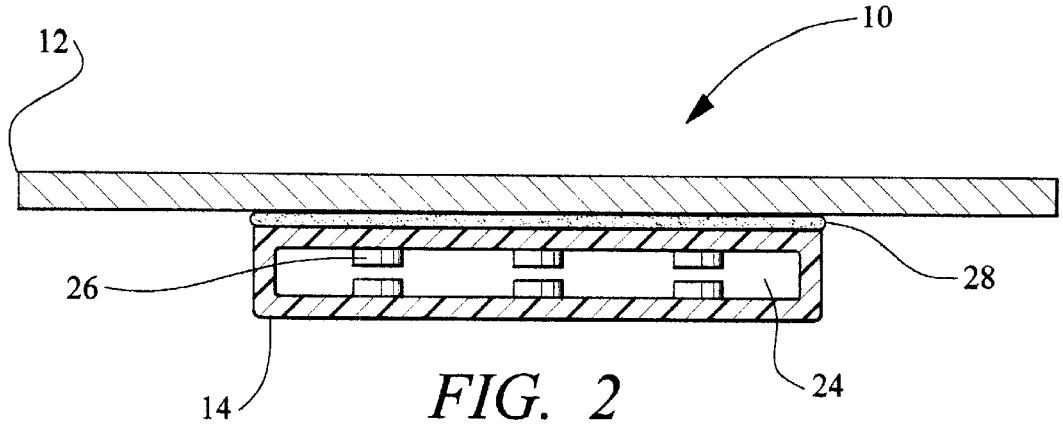
FIG. 2 shows an inside view of the top of a card and gift receptacle attachment having buttons as a closure means.

The card and gift delivery system 10 include a surface 18 having a plurality of graphical images 16 corresponding to the particular predetermined theme of the card 12, such as Happy Birthday 20. In the present embodiment, as shown in FIG. 2, the gift receptacle 14 may be permanently or detachably attached to the surface 18 of the card 12. The gift receptacle 14 can be attached using adhesive, such as glue, or any suitable attachment mechanism 28. The text 22 of the card 12, along with the shape of the gift receptacle 14, combine with the predetermined theme of the card 12 to create a special and unique gift delivery system 10 for the occasion. The gift receptacle 14 can provide an opening 24 to allow gifts to be inserted into the gift receptacle 14. The opening can be formed along the top or bottom of the gift receptacle 14.

Figure 2A:
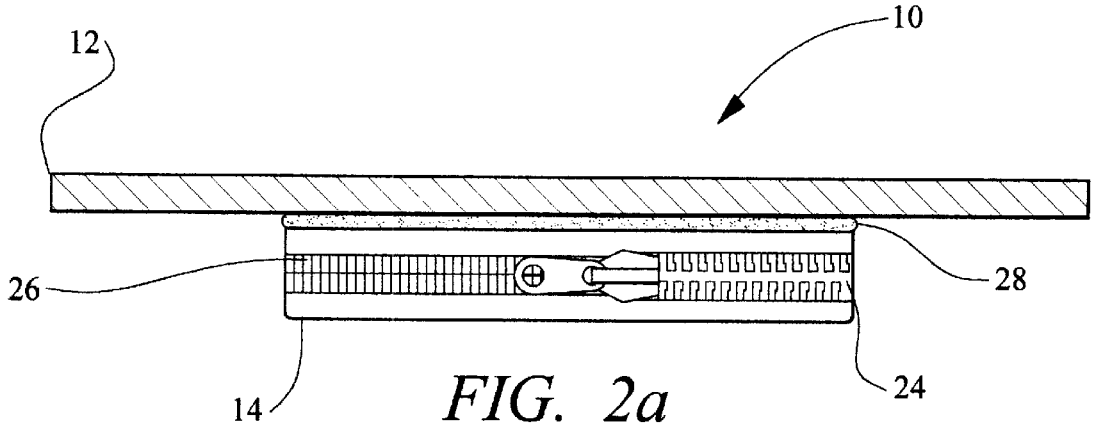
FIG. 2*a* shows a top view of a card and gift receptacle attachment having a zipper as a closure means.
Figure 2B:
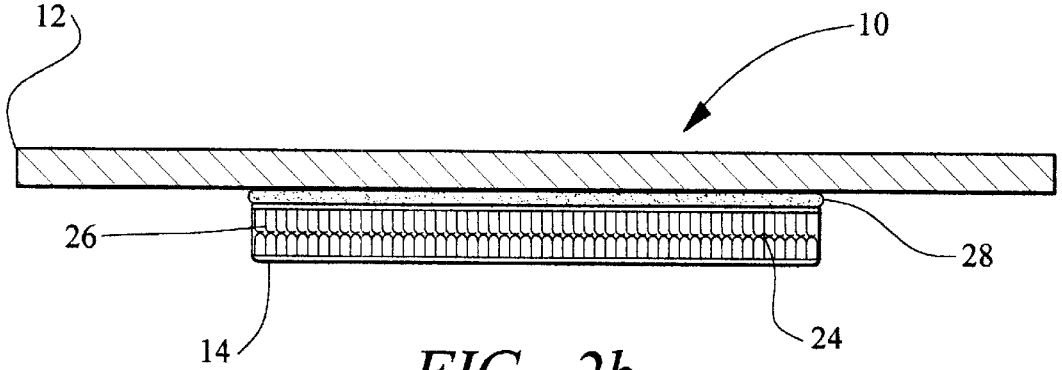
FIG. 2*b* shows a top view of a card and gift receptacle attachment having a hook and loop member as a closure means.

The opening 24 of the gift receptacle 14 can include a closure means 26. The closure means 26 allows a gift item to be securely and safely stored in the gift receptacle 14 after insertion. The closure means 26 can include a zipper, buttons, or hook and loop member. In one embodiment, as shown in FIG. 2, the closure means can include snap-like buttons to completely enclose the inserted gift item. FIGS. 2*a* and 2*b* further illustrate a card member having a zipper and a hook and loop member as a closure means, respectively.

Figure 3:
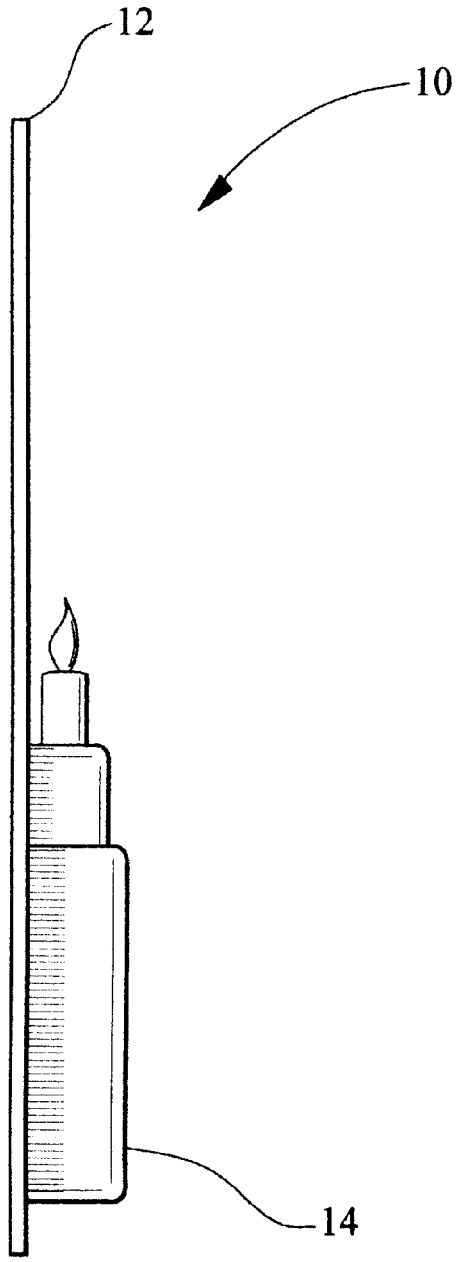
FIG. 3 shows a side view of a card and gift receptacle.

As depicted in FIG. 3, once the opening 24 is properly closed, the gift receptacle 14 allows any appropriately sized gift item to be stored safely and securely. For instance, a ring can be stored in the gift receptacle 14 securely when using the card 12 and gift delivery system 10 for proposing to a loved one. The closure means 26 provide a secure gift receptacle 14, and ensures that the gift item will not be lost during delivery. Gifts of various sizes can be inserted and secured in the gift receptacle 14. The size of the opening 24 may vary, and is not limited to any particular dimensions. For example, an opening of a gift receptacle corresponding to a Christmas theme can have different dimensions than an opening of a gift receptacle corresponding to a Thanksgiving theme. The opening 24 may vary according to the shape and design of the gift receptacle 14.

Figure 4:
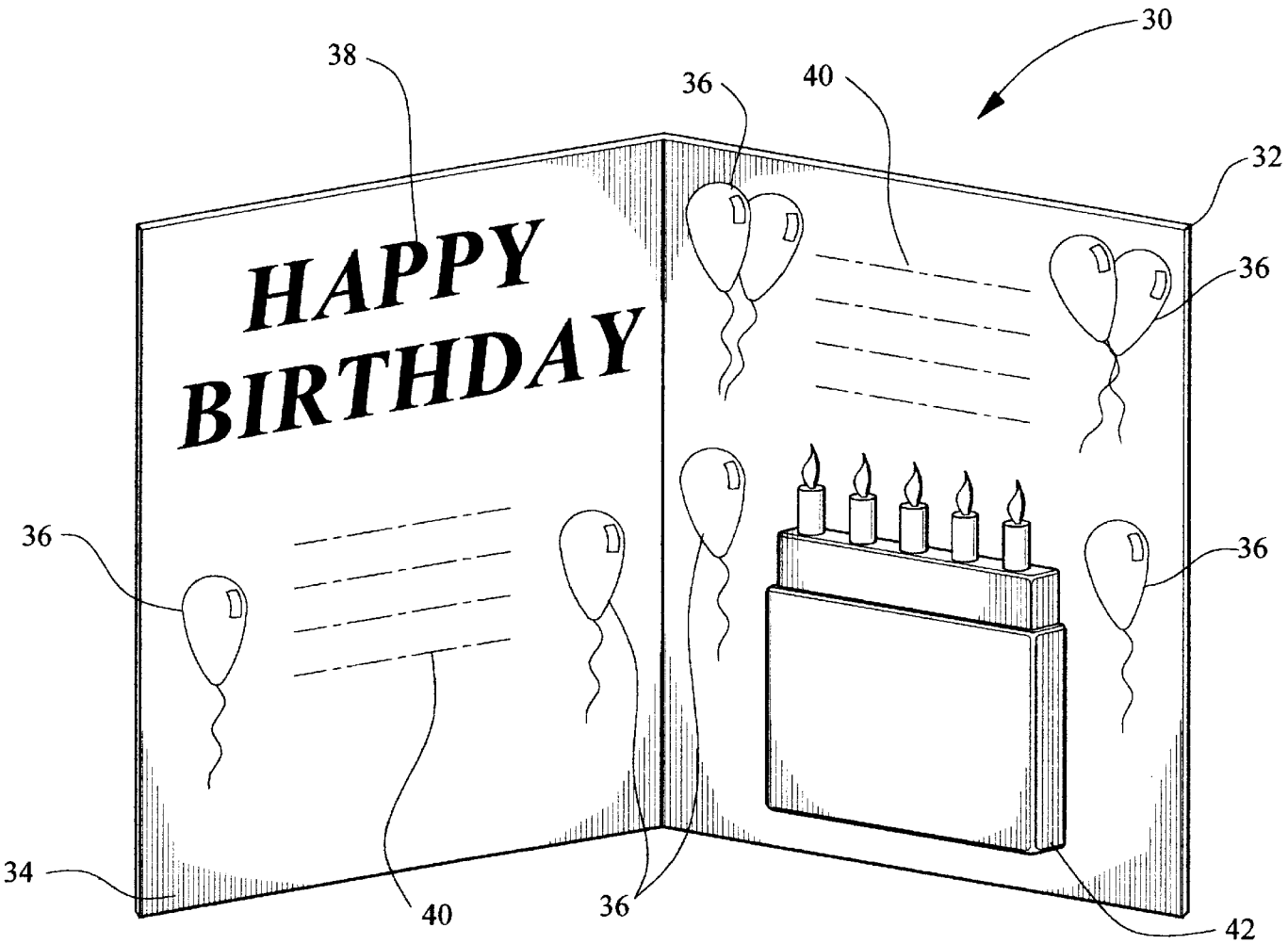
FIG. 4 shows a perspective view of a card and gift delivery system having a plurality of surfaces.

As shown in FIG. 4, the card and gift delivery system 30 may be folded to provide a plurality of surfaces 34. The card 32 may be folded in various arrangements to create a multitude of sides depending on the predetermined theme of the card 32. The card 32 may be folded to create a four-sided or trifold card. A card 32 having a plurality of surfaces 34 may bear text 40 on any surface 34 of the card 32. The text 40 of the card 32 corresponds to the predetermined theme of the card 32, such as a birthday theme 38. The card 32 may also have a gift receptacle 42 located on a surface of the card 32. Additionally, the shape of the graphical images 36 located on the gift receptacle 42 correspond to the predetermined theme of the particular occasion. The card 32 and gift receptacle 42 can be made from any suitable material. For example, the card 32 may be made from card board or paper, while the gift receptacle 42 can be made from any decorative material depending on the particular design of the shape of the gift receptacle 42. For instance, a gift receptacle 42 corresponding to a wedding occasion may have a gift receptacle 42 in the shape of a ring that is constructed from plastic. In celebration of a birthday occasion, the gift receptacle 42 may be in the shape of a balloon, and constructed from cloth.

An embodiment of the present invention may include a four-sided card, as shown in FIG. 4. As illustrated, any surface 34 of the four-sided card may bear text 40 and a graphical image 36 corresponding to the predetermined theme of the card 32. The four-sided card may also include a gift receptacle 42. The shape or design of the gift receptacle 42 corresponds to the predetermined theme of the card 32. The gift receptacle 42 may be attached to any surface 34 of the card 32. However, the gift receptacle 42 is preferably attached to the interior of the card 32. The gift receptacle 42 should blend into the background of the card 32 so as to disguise the existence of a gift item located inside of the gift receptacle 42. The text 40 of the card 32 expresses language corresponding to the particular occasion, along with integrating the predetermined theme of the card 32 between the graphical images 36 and shape or design of the gift receptacle 42. For example, the gift receptacle 42 may be in the shape of a birthday cake and the graphical images 36 on the surface 34 of the card 32 may be balloons. The card 32 may include multiple combinations of graphical images 36 that correspond to the predetermined theme. For instance, in addition to balloons, the card 32 may bear graphical images 36 of confetti and wrapped gifts. The birthday gift item may be inserted into the gift receptacle 42 and appear hidden inside the gift receptacle 42 to the card recipient. The text 40 of the card 32 may reveal to the recipient that a gift is located inside the gift receptacle 42, while also adding an element of surprise.

It will of course be understood that the invention is not limited to the specific details described herein, which are given by way of example only, and that various modifications and alterations are possible within the scope of the invention as defined in the appended claims. For example, the gift receptacle 42 may be located on any surface 34 of the card 32. Also, the text 40 of the card 32 may be located on any surface 34 of the card 32, and can include any form of graphical images 16 which correspond to the predetermined theme of the card 32. Additionally, the dimensions and material composition of the card 32 and gift receptacle 42 may vary accordingly.

What is claimed is:

1. A greeting card and gift delivery system comprising:

a four sided, openable greeting card having two facing interior sides and opposing front and back exterior sides, said two facing interior sides being substantially covered by each other when the greeting card is closed, at least said front exterior side bearing text, said text corresponding to a predetermined theme related to a gift-giving occasion;

a gift receptacle for enclosing a gift item, said gift receptacle being mounted on one of said two facing interior sides;

said gift receptacle having a first surface bearing a graphical image corresponding to said predetermined theme, whereby a gift item is contained in a gift-giving occasion greeting card and is disguised by a gift receptacle that blends into the theme of the card for an added element of gift-giving surprise.

2. The card and gift delivery system of claim 1, wherein said card includes a surface having a plurality of graphical images corresponding to said predetermined theme of said card.

3. The card and delivery system of claim 1, wherein the shape of said gift receptacle corresponds to a graphical image that is representative of said predetermined theme of said card.

4. The card and delivery system of claim 1, wherein said gift receptacle is permanently attached to said surface of said card.

5. The card and delivery system of claim 1, wherein said gift receptacle is detachably coupled to said surface of said card.

6. The card and delivery system of claim 1, wherein said gift receptacle is attached to a surface of said card and has an opening to allow gifts to be inserted into said gift receptacle.

7. The card and delivery system of claim 6, wherein said opening of said gift receptacle has closure means.

8. The card and delivery system of claim 7, wherein said closure means includes one from the group of zippers, buttons, and hook and loop member.

9. The card and delivery system of claim 1, wherein said card is folded to provide a plurality of surfaces.

10. The card and delivery system of claim 9, wherein said text is included on a plurality of surfaces of said card.

11. The card and delivery system of claim 9, wherein said receptacle is located on an inside surface of said card.

12. The card and delivery system of claim 1, wherein said predetermined theme is Valentine's Day.

13. The card and delivery system of claim 12, wherein said graphical shape of said receptacle is one from the group of a heart, cupid, and an arrow.

14. The card and delivery system of claim 1, wherein said predetermined theme is a Birthday.

15. The card and delivery system of claim 14, wherein said graphical shape of said receptacle is one from the group of a cake, balloon, and candle.

16. The card and delivery system of claim 1, wherein said predetermined theme is Easter.

17. The card and delivery system of claim 16, wherein said graphical shape of said receptacle is one from the group of a church, rabbit, and egg.

18. The card and delivery system of claim 1, wherein said predetermined theme is Christmas.

19. The card and delivery system of claim 18, wherein said graphical shape of said receptacle is one from the group of a tree, reindeer, and sleigh.

20. The card and delivery system of claim 1, wherein said predetermined theme is a Wedding.

21. The card and delivery system of claim 20, wherein said graphical shape of said receptacle is one from the group of a ring, chapel, and bride.

* * * * *